US006981854B1

(12) United States Patent
Chang

(10) Patent No.: US 6,981,854 B1
(45) Date of Patent: Jan. 3, 2006

(54) SMALL PISTON PUMP

(75) Inventor: Jerry K. Chang, Largo, FL (US)

(73) Assignee: Chemilizer Products, Inc., Largo, FL (US)

( * ) Notice: Subject to any disclaimer, the term of this patent is extended or adjusted under 35 U.S.C. 154(b) by 397 days.

(21) Appl. No.: 10/455,172

(22) Filed: Jun. 5, 2003

(51) Int. Cl.
*F04B 39/00* (2006.01)
*F04B 53/00* (2006.01)

(52) U.S. Cl. ..... 417/557; 417/415

(58) Field of Classification Search ..... 417/557, 417/415, 416, 502, 564
See application file for complete search history.

(56) References Cited

U.S. PATENT DOCUMENTS

| | | | | | |
|---|---|---|---|---|---|
| 1,294,882 | A | | 2/1919 | Dilks | |
| 1,773,669 | A | * | 8/1930 | Gerling | 417/254 |
| 3,508,793 | A | * | 4/1970 | Bueler | 303/9.62 |
| 3,623,776 | A | | 11/1971 | Wellman | |
| 3,771,908 | A | * | 11/1973 | Rosen | 417/446 |
| 3,890,999 | A | * | 6/1975 | Moskow | 137/505.25 |
| 3,994,307 | A | * | 11/1976 | Loeffler | 131/330 |
| 4,119,113 | A | | 10/1978 | Meginniss | |
| 4,207,924 | A | | 6/1980 | Peters | |
| 4,237,935 | A | | 12/1980 | Delmonte | |
| 4,549,565 | A | | 10/1985 | Short | |
| 5,055,008 | A | | 10/1991 | Daniels | |
| 5,234,322 | A | | 8/1993 | Daniels | |
| 5,762,103 | A | | 6/1998 | Gregoire | |
| 6,298,873 | B1 | | 10/2001 | LaVey | |
| 6,746,217 | B2 | * | 6/2004 | Kim et al. | 417/417 |
| 2005/0158193 | A1 | * | 7/2005 | Roke et al. | 417/417 |

* cited by examiner

*Primary Examiner*—William H. Rodriguez
(74) *Attorney, Agent, or Firm*—Dennis G. LaPointe

(57) ABSTRACT

A small piston pump is disclosed with a housing having a pair of space and connected pistons therein. The housing has a bore with one of the pistons engaging the bore near one end and has a sleeve mounted therein adjacent the other end. The second piston slides in the bore of the sleeve. One end of the sleeve has an inlet covered by a slit valve and in the end of the sleeve adjacent the slit valve it has a radial outwardly extending opening covered by an elastic band to control the flow of fluid thru the radial outward opening. The other end of the sleeve is carried by the housing bore with a passageway therebetween. A pump output opening is disposed in the housing between the sleeve and the one of the pistons.

6 Claims, 2 Drawing Sheets

SMALL PISTON PUMP

BACKGROUND OF THE INVENTION

1) Field of the Invention

This invention relates to small piston pumps generally and more specifically to such a pump having two check valves in a small space along with the piston.

2) Description of the Prior Art

Many devices incorporating elastic bands, such as O rings, as check valves are known in the art, for example U.S. Pat. No. 4,549,565 includes an O ring 38 which serves as a closure member over a discharge port. However, this O ring does not act in conjunction with a slit valve, with both being disposed adjacent to and functioning in conjunction with a small diameter pump stem to dictate the operation of pump.

SUMMARY OF THE INVENTION

The piston pump of this invention has a small diameter reciprocating pump stem which can be connected to and driven by a diaphragm water motor thereby to pump chemical additive to the primary water operating the water motor. Since this is a small additive pump, in prior designs, there was no space to provide a pair of check valves in close conjunction with the small piston. To provide two such check valves in a small space, a flat check valve with a 45 degree cut was selected as the open-close gate valve and an elastic material annular band disposed on the outside of the pump cylinder overlying the pump's exhaust port as an output check valve. The confined space between the flat check valve and the elastic material annular band and between these valves and the piston provide a pressure build up area between the annular band and the flat check valves so that the pressure additive fluid can easily open the output check valve and outflow to be directed to a second piston carried by said first piston which forces the fluid out of the pump to the primary water.

DETAILED DESCRIPTION OF THE PREFERRED EMBODIMENT

Figure 1:
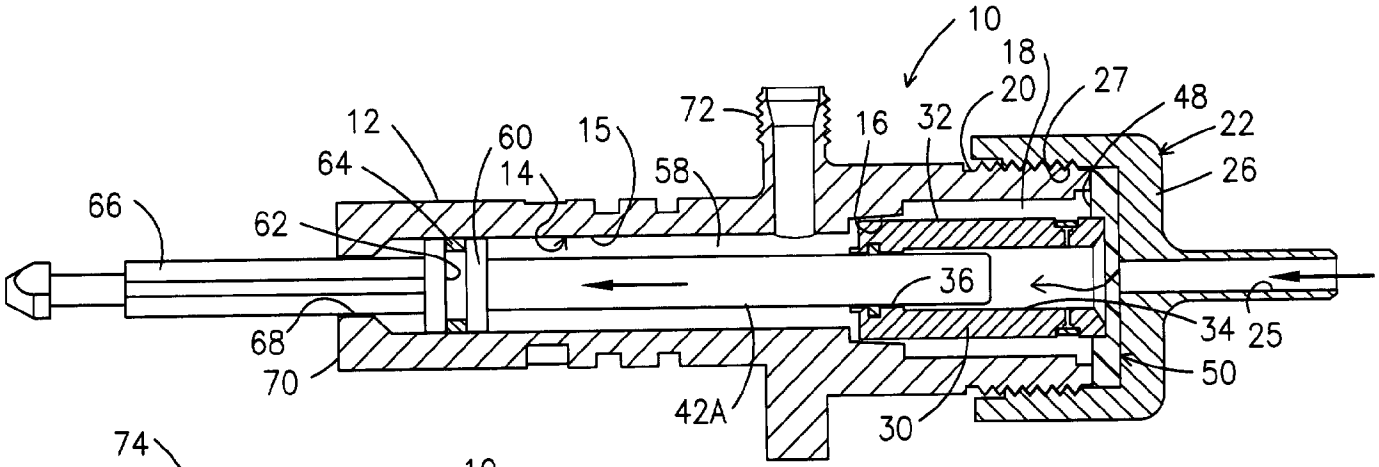
FIG. 1 is a longitudinal cross sectional view showing the piston pump of this invention with the piston moving in the intake direction with the slit valve open and the elastic material annular band in the form of a flat annular band in the closed position.
Figure 2:
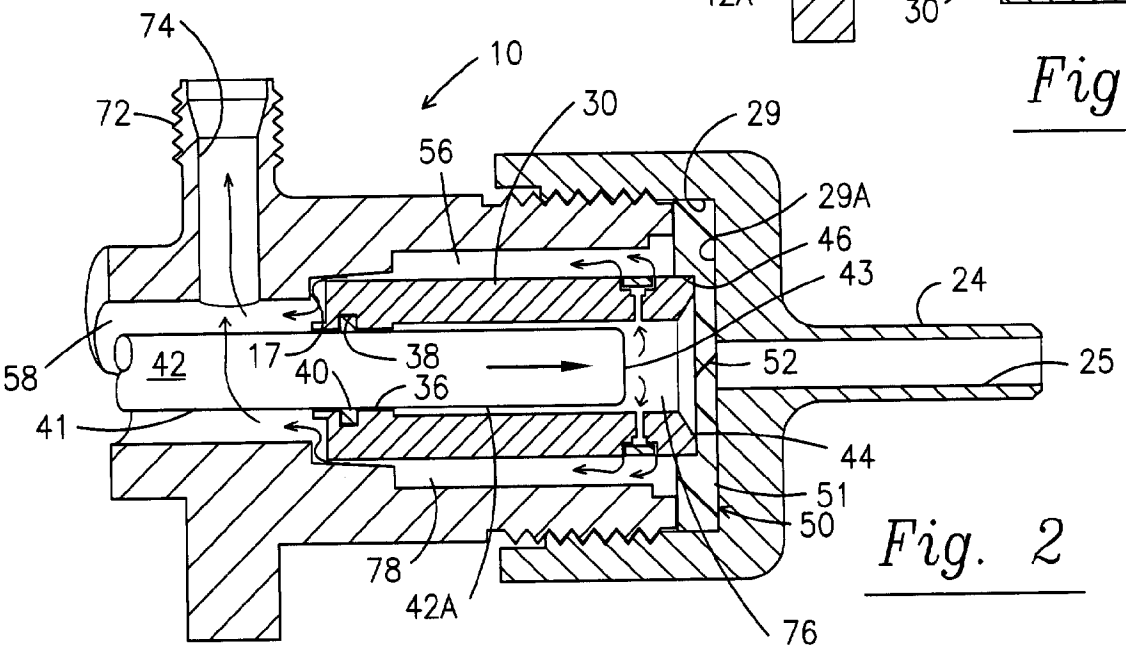
FIG. 2 is an enlarged fragmentary view of the view of FIG. 1 with the piston moving in the output direction and with the slit valve closed and the annular band in the open position.

Referring now to the drawings, and more particularly to FIGS. 1 and 2, a small additive piston pump is shown generally at 10 and includes a housing 12 having a central bore shown generally at 14, which bore has a piston receiving portion 15 on the left portion thereof, a short counterbore portion 16 to the right of bore portion 15, and a larger right end bore portion 18 at the right end of the housing 12. The peripheral surface of the housing 12 at the right end thereof is threaded at 20, and an end cap 22, having an end wall 26 and internal threads 27, is threadedly received on the threads 20 of the housing 12. The end cap 22 has a pintle 24 with a central bore 25 therein; the pintle extending to the right from the end wall 26 of the cap 22 and the bore 25 being confluent with the interior of the end cap 22.

Figure 5:
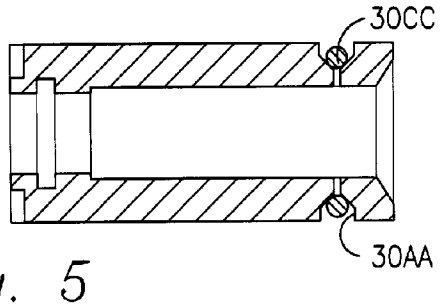
FIG. 5 is view of the pump cylinder of FIG. 1 with the annular elastic band shown as an O ring.
Figure 6:
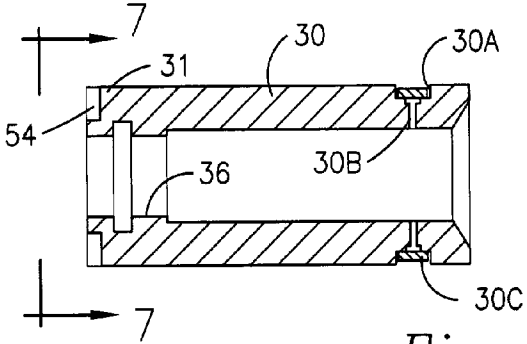
FIG. 6 is a view of the pump cylinder of FIG. 1 taken along the line 6—6 in FIG. 7 with the annular elastic band shown as a flat annular band.
Figure 7:
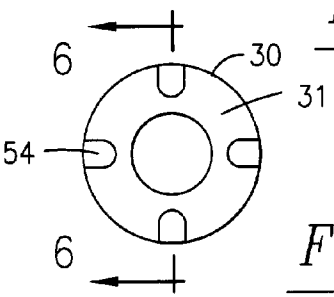
FIG. 7 is a view in full lines of the pump cylinder when seen in the direction of the arrows 7—7 in FIG. 6.
Figure 3:
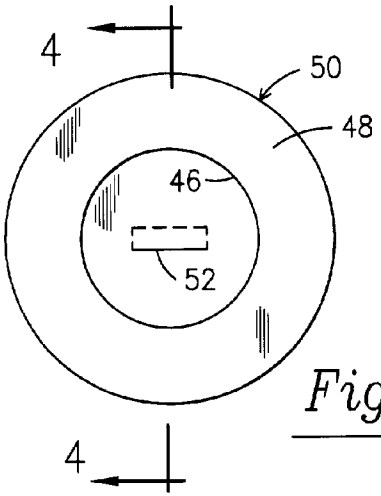
FIG. 3 is an enlarged end view of the slit valve when view from the left in FIG. 1.
Figure 4:
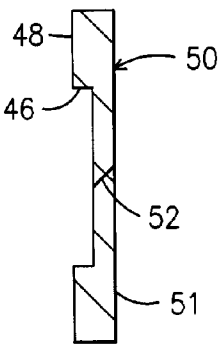
FIG. 4 is a sectional view taken along the line 4—4 in FIG. 3.

Disposed in the bores 16 and 18 of the housing 12 is an annular sleeve 30 having an annular peripheral wall 32 and an internal cylindrical bore 34, which bore has a shoulder 36 adjacent the left end thereof. The shoulder 36 has an annular groove 38 therein intermediate the ends thereof, in which groove is sealingly received an annular sealing ring 40, which ring, on the internal surface thereof, sealingly and slidingly engages the periphery 41 of an elongated piston 42 whose right end 43 reciprocates in the bore 34, such engagement being adjacent the said right end 43. The right end of the sleeve 30 is supportingly received in an annular undercut 46 in the left face 48 of an annular slit valve 50, more clearly seen in FIGS. 3 and 4. The valve 50 has a 45 degree angled slit 52 positioned centrally therein and extending axially therethrough while extending radially a relatively short distance as clearly seen in FIG. 3. The periphery of the valve 50 is received in the right end of a bore 29 formed in the cap 22, and the right face 51 of the valve abutting the inner end wall 29A of the end cap 22 with the slit 52 overlying the bore 25 in the pintle 24. The left end 31 of the sleeve is fittingly received and supported in the counterbore 16, and the sleeve 30 has a plurality of detents 54 formed therein, which detents are open to the periphery of the sleeve 30, while being closed to the bore 34 of the sleeve. The detents 54 are deep enough (extend to the right sufficiently) so that where the detents are open to the periphery of the sleeve, the sleeve periphery is spaced from the tapered surface of the counterbore 16, and the left end 31 of the sleeve 30 abuts the shoulder 17 formed at the left end of the bore 16. While the periphery of the sleeve 30 intermediate the detents 54 engages the bore 16, since the bore 16 is tapered, the peripheral detent openings are spaced from the bore 16 and form an open passageway leading from the area 56 which lies between the periphery 32 of the sleeve 30 and the bore 18 of the housing 12, to the area 58 which lies between the piston 42 and the bore 14. The cylindrical sleeve 30 has an annular flat bottomed and flat sided peripheral groove 30A therein adjacent the right end thereof, which groove has a plurality of circumferentially spaced openings 30 B extending from the bottom of the groove and opening to the bore 34 of the sleeve 34. In the embodiment of FIGS. 1,2, and 6, an annular elastomeric band 30C, having a flat external and internal periphery, is sealingly disposed in the groove 30 A; which band resiliently seals the openings 30 B unless the band is acted upon. In FIG. 5, the groove 30AA is semicircular and the elastomer member is a O ring 30CC, whose function is the same as the flat ring 30C described above re FIG. 6.

The piston 42 has a stem portion 42A on the right side thereof, which portion is sealingly and slidingly received in the sealing ring 40, while the left side portion of the piston 42 includes an enlarged cylindrical shoulder 60 which has an annular grove 62 formed therein. Received in the grove 62 is a elastomeric sealing ring 64, which slidingly and sealingly seals the juncture of the piston's shoulder 60 with the piston receiving portion 15 of the bore 14. To the left of the shoulder 60 an attaching projection 66 extends out of and projects from an opening 68 in the left end wall 70; which opening and the projection are formed with a matching irregular shape that allows relative axial movement while preventing relative rotation. The projection 66 can be attached to a suitable source of axial reciprocating driving force to operate the pump 10 in a manner hereinafter described, such as a water motor being driven by primary water, with the piston pump 10 supplying an additive to the primary water. The housing 12 of the pump 10 includes a radially extending externally threaded projection 72, which projection has a central bore 74 therein which is confluent with area 58 in the bore portion 15 of the bore 14. A suitable conduit (not shown) connects the projection, and thereby the pump's effluent, to the desired receiving location, such as the primary water (not shown).

The operation of the pump 10 will now be described: upon movement of the projection 66 to the left as seen in FIG. 1, the right end 43 of piston 42 increases the volume in the cylinder 30 in the area 76 to the right of the sealing ring 40. The accompanying reduction of pressure in area 76 moves the flat elastomeric member 30C to tightly close the openings 30B and causes the slit 52 in the adjacent valve 50 to open to thereby admit additive fluid to area 76 from the bore 25. Upon reciprocal movement of the projection 66 to the right from its leftward position, as shown in FIG. 2, the piston 42 decreases the area 76 thereby increasing the pressure therein, with the result that the slit valve 50 closes and the band 30C opens the openings 30B so that additive fluid in the area 76 can move radially outwardly to the space 78 surrounding the sleeve 30, thence through the detents 54 to the area 58 and from the latter out through the opening 74 where it can be conducted to join the primary water.

While only a single embodiment along with a valve modification has been shown and described, it is understood that changes can be made therein without departing from the scope of this invention as hereinafter claimed.

What is claimed is:

1. A small piston pump comprising in combination,

A) housing having a bore therein with a pair of spaced opposed ends and having a sleeve in said bore adjacent one end of said bore, 1) said one end of said bore having an inlet opening therein and having a slit valve overlying said inlet opening and controlling the flow of fluid therethrough, B) said sleeve having a periphery thereabout spaced from said housing bore and having an axially extending bore therein and having a pair of axially opposed ends with one of said ends being disposed adjacent said slit valve whereby to receive fluid into said sleeve bore flowing into said housing through said slit valve, and the other of said sleeve ends being axially spaced from said one end and engaging and being supportingly carried by said housing within said bore thereof, C) said sleeve having a radial passageway therein adjacent said one end thereof which leads from the sleeve bore to the periphery of said sleeve and said sleeve carrying an annular elastic valve member overlying said radial passageway, D) second passage means in one of said bore and sleeve for conducting fluid from the area of the periphery of said sleeve to the area of said housing bore past the engagement of said sleeve and said housing, E) an elongated piston with a first end thereof disposed in said sleeve and sealing and slidingly supported thereby and having a second end axially spaced from said first end and slidingly and sealingly engaging said housing within the bore thereof, said engagement being disposed axially beyond said second passage means, F) and an outflow opening from said housing disposed between said second passage means and said second end of said piston, and G) means operatively connected to said piston and projecting from said housing for reciprocating said piston.

2. A piston pump according to claim 1 wherein said elastic valve member is an O ring.

3. A piston pump according to claim 1 wherein said annular elastic valve member has a flat internal cylindrical surface.

4. A piston pump according to claim 1 wherein said second passageway is a plurality of circumferentially spaced detents formed in said other end of said sleeve, which detents open to the peripheral surface of said sleeve and said other end of said sleeve.

5. A piston pump according to claim 1 wherein said one end of said sleeve engages said slit valve.

6. A piston pump according to claim 5 wherein said slit valve has an annular undercut therein and said one end of said sleeve engages said slit valve within said undercut.

* * * * *